United States Patent [19]

Eckley

[11] Patent Number: 4,860,405

[45] Date of Patent: Aug. 29, 1989

[54] APPARATUS FOR DRYING MATERIAL TRANSPORTED IN A FLUID STREAM

[76] Inventor: Robert C. Eckley, 1424 Claire Ave., Corcoran, Calif. 93212

[21] Appl. No.: 186,303

[22] Filed: Apr. 26, 1988

[51] Int. Cl.[4] ..... D01B 1/48

[52] U.S. Cl. ..... 19/0.27

[58] Field of Search ..... 19/0.27, 66 CC

[56] References Cited

U.S. PATENT DOCUMENTS

| | | | |
|---|---|---|---|
| 2,025,701 | 12/1935 | Mitchell | 19/0.27 |
| 2,129,630 | 9/1938 | Streun | 19/0.27 |
| 2,214,680 | 9/1940 | Sims . | |
| 2,421,477 | 6/1947 | Blewett | 19/66 CC |
| 3,277,581 | 10/1966 | Towery et al. | 19/0.27 |
| 3,331,137 | 7/1967 | Merkel et al. . | |
| 4,031,593 | 6/1977 | Vandergriff | 19/0.27 |
| 4,143,470 | 3/1979 | Vandergriff . | |

*Primary Examiner*—Werner H. Schroeder
*Assistant Examiner*—Douglas E. Price

[57] ABSTRACT

An apparatus for drying material transported in a fluid stream including a nozzle borne in the described embodiment by a suction tube of a cotton gin and defining an air channel which is operable to direct a stream of heated air to the intake end of the nozzel; a fan and a conduit are mounted in fluid transferring relation with the nozzle and are operable to deliver air to the nozzle; and a heater borne by the conduit is adapted to impart heat energy to the air passing therethrough, the heated air discharged by the nozzle adapted to dry the cotton drawn into the suction tube thereby decreasing the moisture content thereof and facilitating the removal of trash therefrom.

11 Claims, 2 Drawing Sheets

APPARATUS FOR DRYING MATERIAL TRANSPORTED IN A FLUID STREAM

BACKGROUND OF THE INVENTION

1. Field of the Invention:

The present invention relates to an apparatus for drying material transported in a fluid stream and more particularly to an apparatus having particular utility when employed to dry cotton fiber during transport into a cotton gin, the apparatus in the described embodiment mounted on the intake end of a suction tube at a cotton gin and adapted substantially to dry the seed cotton drawn through the suction tube to improve the grade of cotton fiber produced by the gin by facilitating the removal of trash and moisture from the seed cotton prior to any further mechanical manipulation thereof.

2. Description of the Prior Art:

In the cotton industry and more particularly in the ginning of unprocessed, or "seed cotton", to produce bales of cotton fiber, or "lint", the removal of moisture from the seed cotton has long been recognized as important. The cotton bales, upon leaving the gin, are thereafter individually graded and sold to cotton mills where the lint is subsequently blended, cleaned, carded, and spun into yarn for many uses. The grade of the lint is directly dependent upon the quantity of trash remaining therein. Those skilled in the art have long recognized that the harvesting of high moisture seed cotton presents a significant problem with respect to the quality of the lint produced therefrom. More particularly, and as noted in United States Letters Pat. No. 4,143,470 to vandergriff, it has long been known that drying the lint to a low moisture content improved the efficiency of the seed cotton cleaning achieved at the gin. Thus, notwithstanding the mass of leaf trash and stems pervading the seed cotton as a result of mechanical harvesting, lowering of the moisture content of the seed cotton enhances the ability of the ginning process to remove such trash and thereby correspondingly increases the grade of the lint. Seed cotton drying, as now practiced in the industry, utilizes various combinations of driers, from one to several, which are individually disposed at various locations in the ginning process and are employed in combination with assorted other equipment.

The prior art is replete with numerous examples of heaters which are operable to reduce the moisture content of the lint which is processed by a cotton gin. While these prior art devices have operated with varying degrees of success, they have been unsatisfactory in several respects. For example, the suction system currently in use in the industry employs a hot air plenum which is substantially sealingly mounted about a feed or intake conveyor and is operable to impart drying heat to a continuous stream of seed cotton which has been mechanically manipulated by a series of feeder dispensing cylinders which tear and shred the seed cotton. This previous mechanical manipulation, of course, makes the removal of trash more difficult because the trash is shredded finely, and thereby firmly imbedded in the seed cotton. It should be understood therefore, that trash removal under the present practice becomes a much more difficult task.

The inventor has discovered that the application of heat energy to the seed cotton prior to any mechanical manipulation thereof facilitates, or, otherwise has the effect of causing the seed cotton locks to open, thereby having the attendant benefits of permitting the ready removal of increased amounts of trash. This action of "unlocking" the seed cotton permits the early removal of trash prior to any mechanical manipulation of same and has the overall effect of improving the grade of lint produced and thus permits the bales to bring a better price at market. Insofar as the applicant is aware, this has not previously been known.

Another deficiency encountered with respect to the above-identified prior art industrial practice results from characteristics inherent in the individual equipment's design inasmuch as the hot air plenum utilized in such equipment must employ a relatively complex sealing mechanism which is operable substantially to limit the amount of cold ambient air which is drawn into the suction system. This operational requirement to limit the intake of cold ambient air causes the hot air plenum, by necessity, to be mounted in a fixed location over an intake conveyor or other similar device thereby limiting its operational flexibility.

Moreover, another problem encountered with the prior art devices and practices which have been designed for delivering drying air to a gin is the propensity for these mechanisms to exhibit a characteristic inability to cooperate with other devices in the gin in the same or adjoining work stations.

Therefore, it has long been known that it would be desirable to have an apparatus for drying material transported in a fluid stream and which is operable, in the described embodiment, to deliver a predetermined volume of drying air to a conventionally designed gin; the apparatus of the subject invention adapted to dry seed cotton delivered to a cotton gin to a low moisture content while simultaneously facilitating the removal of trash and other debris, is both highly efficient in operation and provides maximum flexibility during the operation thereof, is operable to reduce to an absolute minimum the assorted problems associated with the prior art devices and practices, and has the attendant benefit of producing a higher quality lint than has heretofore been possible.

OBJECTS AND SUMMARY OF THE INVENTION

Therefore, it is an object of the present invention to provide an improved apparatus for drying material transported in a fluid stream.

Another object is to provide such an apparatus which is particularly well suited to being mounted on a suction tube of a conventional cotton gin and which is operable to deliver a substantially continuous volume of heated air to the intake end thereof to facilitate the drying of seed cotton drawn therethrough.

Another object is to provide such an apparatus which is operable to deliver the predetermined volume of heated air in a substantially uniform distribution pattern about the intake end of the suction tube.

Another object is to provide such an apparatus which cooperates with the suction tube facilitating the pick up and transport of seed cotton from diverse areas thereby substantially increasing its versatility.

Another object of the present invention is to provide such an apparatus which is operable to achieve increased energy savings through the employment of efficient designs of heaters and air mover subassemblies thereby having the attendant benefit of decreasing the operating expenses related to same.

Another object of the present invention is to provide such an apparatus which can be readily mounted on most models and designs of commercially available cotton gins and their associated suction tube assemblies in the manner of a retrofit or alternatively manufactured as a single subassembly.

Another object of the present invention is to provide such an apparatus which can be readily accessed for purposes of maintenance, modification or the like.

Another object of the present invention is to provide such an apparatus which is operable to obtain the individual benefits to be derived from related prior art devices while avoiding the detriments individually associated therewith.

Another object is to provide such an apparatus which is characterized by its ease of utilization, efficiency of operation, and which can be sold, installed, and maintained at a relatively nominal cost.

These and other objects and advantages are achieved in an apparatus for drying material transported in a fluid stream of the present invention which, in the preferred embodiment, includes a nozzle slidably received on the suction tube of a cotton gin, and defining an intake end and an air channel, the air channel operable to deliver a source of heated air into the immediate vicinity of the intake end of the air nozzle; and an assembly for heating and supplying the heated air to the nozzle is connected in fluid transferring relation therewith, the heated air operable to decrease the moisture content of the seed cotton entering into the suction tube with the attendant benefits to be derived from such moisture content reduction.

DESCRIPTION OF THE PREFERRED EMBODIMENT

Figure 1:
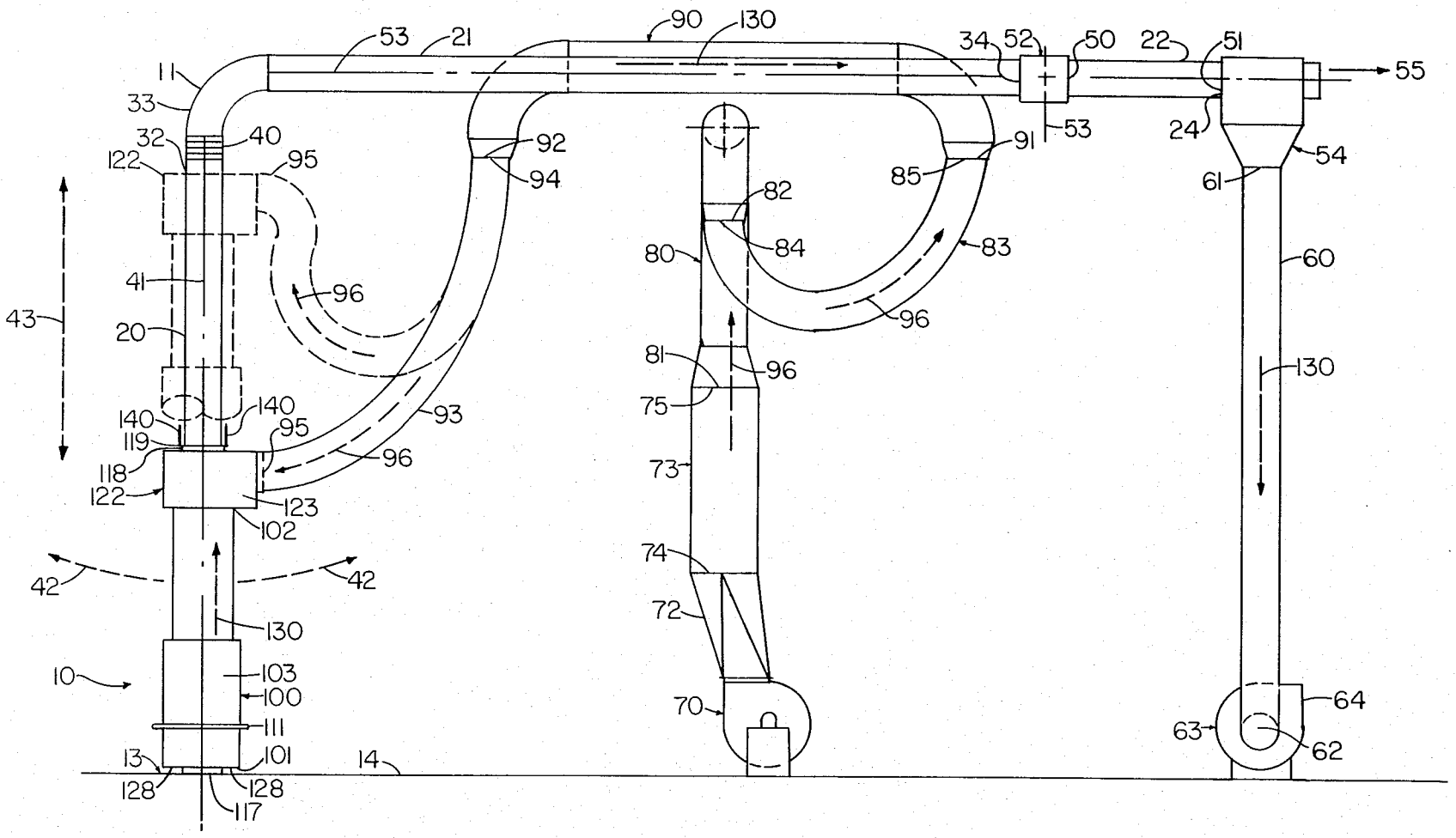
FIG. 1 is a side elevation of the apparatus for drying a material transported in a fluid stream of the present invention shown mounted on and functional as an operable part of a conventional suction tube assembly of a cotton gin.
Figure 2:
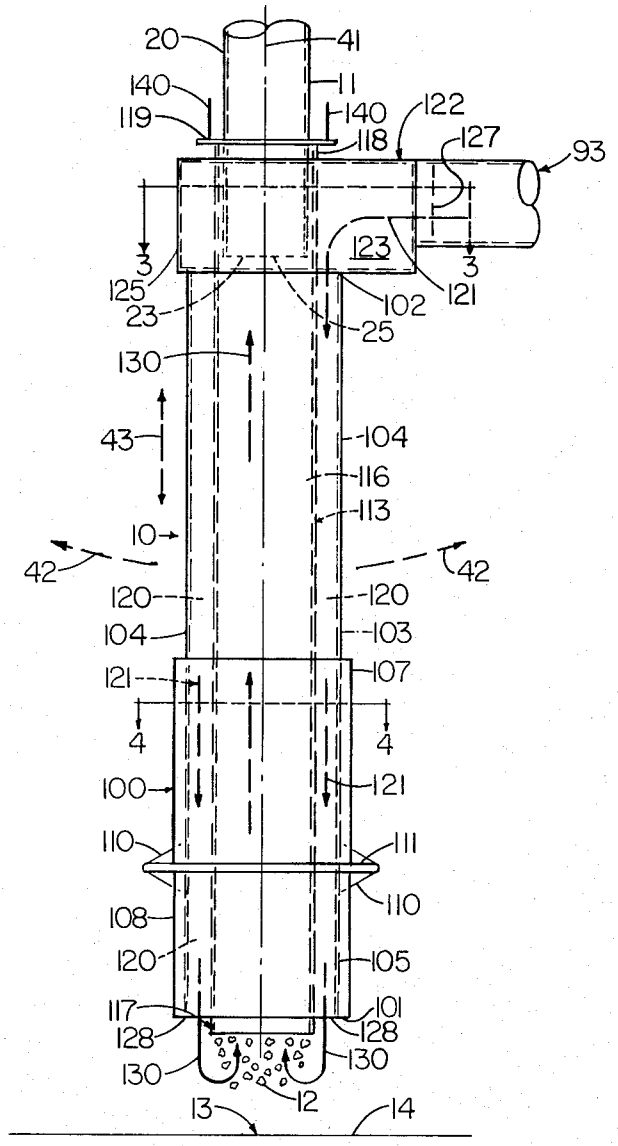
FIG. 2 is a somewhat enlarged, fragmentary side elevation of the apparatus of FIG. 1.

Referring more particularly to the drawings, the apparatus for drying material in a fluid stream of the present invention is generally indicated by the numeral 10 in FIGS. 1 and 2. For illustrative convenience, the apparatus shown and described herein is discussed as it would be configured if it were installed as an operable subassembly on a conventionally configured suction tube 11 which transports seed cotton 12 from a pickup point 13 into a conventional cotton gin, not shown. The pickup point shown herein is illustrated as being located on the surface of the earth 14, however, it should be understood that the pickup point could be located in diverse areas, such as for example, on a conveyor belt, a cotton module, in a farm trailer, or in other selected locations as operational requirements may dictate. Further, it should be understood that the apparatus of the subject invention can be manufactured either as a component part of a completely new suction tube assembly, or alternatively installed on an existing suction tube assembly in the manner of a retrofit. This, of course, greatly increases its versatility.

Figure 3:
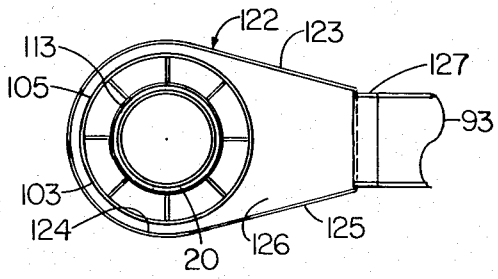
FIG. 3 is a fragmentary transverse section of the apparatus of the instant invention taken on line 3—3 in FIG. 2.

As best understood by a study of FIG. 1, the suction tube 11 has first, second, and third sections that are generally indicated individually by the numerals 20, 21 and 22, respectively, and which are serially interconnected together in fluid transferring relation. The suction tube 11 is manufactured from a metalalloy or other suitable synthetic materials which are resistant to damage occasioned by exposure of same to predetermined amounts of heat energy. The suction tube has an intake end 23 which also is the first end of the first section 20. The suction tube further has a discharge or second end 24 which is connected in fluid transferring relation with the cotton gin, not shown. As best shown in FIGS. 2 and 3, the intake end of the suction tube has a substantially circular peripheral edge 25. Further, the first, second, and third sections 20, 21, and 22, respectively, each have an outside or exterior surface 30 and an opposed inside or interior surface 31. The first section 20 has a second end 32, and the second section 21 has first and second ends 33 and 34, respectively, which are individually mounted on, and disposed in fluid transferring relation between the first and third sections 20 and 22, respectively. Mounted on, and disposed in fluid transferring relation between the first and second sections 20 and 21, respectively, is a flexible joint 40. Further, the first section 20 has a longitudinal axis which is indicated by the line labeled 41, and the joint 40 is operable to permit the first section to be moved into various attitudes along substantially arcuate paths of travel, such as indicated by the arrows labeled 42. It will be understood that the flexible joint operates in the manner of a swivel joint so that such movement relative to a horizontal plane is possible through a range of 360 degrees. The apparatus 10, as will hereinafter be described in greater detail, can be moved along the first section 20 of the suction tube 11 along the path indicated by arrows 43. As best shown in FIG. 1, this movement has the attendant benefit of allowing the apparatus to pick up seed cotton 12 from diverse locations such as, for example, from a conveyor belt, a cotton module or farm trailer.

The third section 22 of the suction tube 11 has a first end 50 and a second end 51, respectively, which is also the discharge end 24 of the suction tube 11. The first end 50 and the second end 34 of the second section 21 are mounted in fluid transferring relation to a swivel joint 52 of conventional design. The swivel joint 52 has a vertical axis 53 and permits the second section to rotate in a horizontal plane about the vertical axis of the swivel joint 52 thereby permitting the first section 20 and thereby, as will subsequently be discussed in greater detail, the apparatus 10 to be further oriented in a wide variety of positions and attitudes along the paths of travel 42. Mounted in fluid transferring relation on the second end 51 of the third section is an air cotton separator 54 of conventional design which is familiar to those skilled in the art. The separator, of course, separates the seed cotton 12 from its transport medium, the conveying air, and diverts the seed cotton along the path of travel 55 where it is transported on to the next ginning process. The air cotton separator further is operable to divert the air into a first air conduit 60 which has a first end 61 which is mounted in substantially air tight fluid transferring relation with the air cotton separator, and a second end 62 which is mounted in fluid transferring relation with a fan 63 of conventional design. The fan 63 is mounted on the surface of the earth 14, or other supporting surface, and is adapted to draw the air along the first conduit and discharge it out through an exhaust port 64. This is best shown in FIG. 1.

A fan 70 of conventional design is operable to draw in substantially clean ambient air through an intake port, not shown, and is adapted to urge the ambient air into a second conduit 72 which is mounted in substantially air tight, fluid transferring relation thereto. As should be understood, increased energy savings can be achieved by utilizing an energy efficient fan design such as that characterized by an air foil type fan. However, it should be noted that the apparatus 10 will operate effectively by utilizing a less efficient fan design. The second conduit, which can be manufactured from a metal alloy such as twenty-gauge galvanized sheet metal, is connected in fluid transferring relation with a heater 73 also of conventional design. Similarly, in this instance, increased energy savings can be achieved by utilizing an energy efficient heater. The heater 73 is operable to impart heat energy to the ambient air which is being delivered thereto such that the temperature thereof is elevated, for example, to approximately 350 degrees Fahrenheit. It should be understood that higher temperatures can be imparted to the ambient air provided, of course, that the air conduits transporting the air can withstand such temperatures. It should also be understood that temperatures of lower magnitude can be imparted to the ambient air as appropriate to the moisture content of the cotton received. The heater 73 has a first end 74 which is mounted in substantially air tight fluid transferring relation with the second conduit 72 and a second end 75 which is mounted in substantially air tight, fluid transferring relation to a third conduit which is generally indicated by the numeral 80. The third conduit, which can be manufactured from a twenty-gauge sheet metal, or other similar material, also has first and second ends 81 and 82, respectively. The second end 82 is mounted in substantially air tight fluid transferring relation to a fourth conduit 83. The fourth conduit is manufactured from suitable flexible ducting material. The fourth conduit has a first end 84 which is mounted in fluid transferring relation to the second end 82 of the third conduit and a second end 85 which is mounted in fluid transferring relation with a fifth conduit generally indicated by the numeral 90.

The fifth conduit 90 is disposed in substantially parallel, fixed spaced relation to the suction tube 11 and has first and second ends 91 and 92, respectively. The first end 91 is mounted in substantially air tight fluid transferring relation to the second end 85 of the fourth conduit and the second end 92 is mounted in substantially air tight fluid transferring relation with a sixth conduit 93. The sixth conduit, which is also manufactured from suitable flexible ducting material, also has first and second ends which are indicated by the numerals 94 and 95, respectively. The direction of movement of the heated ambient air along the conduits 80, 83, 90 and 93, respectively, is generally indicated by the arrows labeled 96.

The apparatus 10 of the subject invention is received about and slidably movable along the first section 20 of the suction tube 11. The apparatus has an air nozzle, generally indicated by the numeral 100. The nozzle 100 has a proximal or first end 101 and further has a second or distal end 102 which is operable to receive the heated air from the sixth conduit 93. The nozzle has a substantially cylindrically shaped main body 103 which defines an outside portion or outer hollow cylinder 104, and the outside portion 104 has opposed exterior and interior facing surfaces 105 and 106, respectively. As best seen by reference to FIGS. 2 and 4, a commercially available insulative material 107 is wrapped or otherwise applied about the exterior facing surface 105 of the outside portion 104 in close proximity to the proximal end thereof. The insulative material is operable to prevent an operator from burning or otherwise injuring himself in the event he comes into contact with the exterior surface 105 which is heated by the heated air passing through the apparatus. The insulative material has an outwardly disposed surface 108 which is typically manufactured from a heat resistant material.

Figure 4:
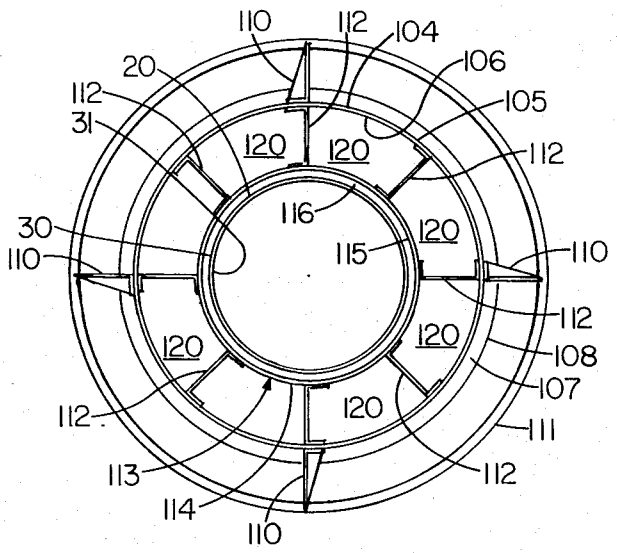
FIG. 4 is a somewhat enlarged, transverse, horizontal section taken on line 4—4 in FIG. 2.

As best understood by reference to FIGS. 2 and 4, a plurality of mounting brackets 110 are affixed by welding or other suitable fastening, in substantially equidistant positions about the exterior surface 105 of the outside portion 104. The brackets 110 mount a substantially circular shaped hand grip 111. The hand grip permits an operator conveniently to handle the nozzle 100 of the apparatus 10. A plurality of spacers 112 are individually affixed to the inside surface 106 of the outside portion 104 using welding or other fastening techniques. The spacers 112, which are disposed in substantially equidistantly spaced relation along the inside surface, are adapted individually to mount a substantially cylindrically shaped inside portion or inner hollow cylinder 113 which is disposed substantially along the longitudinal axis 41 of the first section 20. The inside portion 113 has an exterior facing surface 114 which is affixed to the plurality of spacers 112, and an opposed interior surface which is designated by the numeral 115. The interior surface 115 defines a space 116 into which the first section 20 of the suction tube 11 is slidably and telescopingly received.

As best shown in FIG. 1, and more particularly in the illustration of the apparatus shown in phantom lines in FIG. 1, the apparatus 10 with its air nozzle 100 and the first section 20 of the suction tube 11 can be positioned in various attitudes along the paths of travel 42. This allows the air nozzle of the apparatus to pick up and transport seed cotton 12 from assorted locations, such as from a conveyor belt, a cotton module, a farm vehicle, or the like. This movement is made possible, in part, by the slidable movement of the apparatus 10 upwardly and downwardly along the first section 20 of the suction tube 11 and along the path of travel indicated by arrows 43. The inside portion 113 has an intake or proximal end 117 and a discharge or distal end 118. Further, a substantially continuous flange 119 is mounted on the distal end 118 and is mounted in supported relation on a suitable counter-weight assembly 140 shown fragmentarily in FIGS. 1 and 2. Such counter-weight assemblies are familiar to those skilled in the art. The counter-weight assembly mounts and supports the apparatus for movement by an operator along the first section 20. Thus, the counterweight assembly is operable to permit the operator easily to move the apparatus 10 upwardly and downwardly along the first section 20 of the suction tube 11 as described. The apparatus 10 also moves with the first section 20 through the range of movement previously described and illustrated by paths of travel 42.

An air channel, which is generally indicated by the numeral 120, is defined between the exterior surface 114 of the inside portion 113, and the inside surface 106 of the outside portion 104. The air channel further defines a first path of travel 121 for the heated air which is received from the sixth conduit 93. An intake housing 122 is mounted to the distal end 102 of the nozzle 100 and is operable to receive and divert the main body 123 with inside and outside surfaces 124 and 125, respectively. A cavity 126 is defined between the inside and outside surfaces and is disposed in fluid communication with the air channel 120. The intake housing has an intake port 127 which is operable to mate in substantially air tight, fluid transferring relation with the sixth conduit 93. As shown in FIGS. 1 and 2, the fan 63 is operable to draw the heated air discharged from the air nozzle 100 through the intake end 117 into the inside portion 113 of the same air nozzle and then on into the first section 20 of the suction tube 11. The heated air, when drawn back into the inside portion 113 of the air nozzle, moves in a second path of travel which is indicated by the arrows labeled 130 and in a substantially opposite direction to that of the direction of movement of the first path of travel 121. As best shown in FIGS. 2 and 4, the nozzle is operable to deliver a substantially uniform pattern of heated ambient air to the area immediately adjacent to the intake end 117 of the inside portion 113.

OPERATION

The operation of the described embodiment of the present invention is believed to be readily apparent and is briefly summarized at this point.

The subject invention is best understood by a study of FIGS. 1 and 2. As illustrated therein, the apparatus is mounted in substantially air tight, telescoping, fluid transferring relation, on and about the first section 20 of the suction tube 11, and is operable to receive a predetermined volume of heated ambient air which is delivered thereto. The heated air travels through the conduits 80, 83, 90, and 93 and into the distal end 102 of the air nozzle 100. Upon reaching the air nozzle, the heated air is directed by the intake housing 122 into the air channel 120 and then along the first path of travel 121. The heated air then exits out of the air channel 120 through the opening 128 and is drawn, with the seed cotton, into the intake end 117 of the inside portion 113. In so doing, the heated air is operable to dry the high moisture content seed cotton 12.

The fan 63 is operable to draw the heated air and the seed cotton 12 into the inside portion 113 of the air nozzle 100 and along the second path of travel 130. The heated air and the seed cotton travel, thereafter, along the first, second and third sections 20, 21, and 22, respectively. The seed cotton is directed into the gin by the air cotton separator 54 for further processing and the heated air is discharged through the exhaust port 64 of the fan 63. As should be understood, the volume of air moved by the individual fans 63 and 70, respectively, is preferably substantially balanced, that is, the volume of heated air delivered by the fan 70 to the air nozzle 100 is substantially equal to the volume of air drawn in by the fan 63.

The drying of the seed cotton in this manner prior to any mechanical manipulation thereof in the cotton gin, operates to cause the locks of the seed cotton to open so that, during the subsequent ginning operation, the trash intermixed therewith is more readily removed.

Therefore, it will be seen that the apparatus 10 of the present invention has particular utility when mounted on and used in combination with a suction tube 11 of the cotton gin, the apparatus providing a fully dependable and practical means by which high moisture content seed cotton 12 can be dried prior to any mechanical manipulation thereof. Further, the application of heat to unprocessed high moisture seed cotton has the effect of causing the seed cotton much more readily to give up the trash thereby facilitating the early removal of trash from the cotton fiber so that the trash does not become to readily and irremovably entangled with the cotton fiber during the remainder of the ginning operation. As earlier discussed, the removal of increased amounts of trash increases the quality of the lint produced by the ginning process thereby causing the lint to bring a better price at market. The apparatus is both of dependable and sturdy design and is relatively simple to maintain and inexpensive to operate.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for drying material transported in a fluid stream, the apparatus adapted to be mounted on a conduit and which is operable to transport the material therethrough, the apparatus comprising:

a nozzle adapted to be received on the conduit and having a main body defining an intake end and further having a fluid channel with an opening disposed adjacent to said intake end of the main body; and means for supplying heated fluid to said fluid channel for discharge from the opening and movement into the intake end of the main body to dry said material entering into the main body.

2. The apparatus of claim 1 wherein the conduit is a suction tube of a cotton gin and said material is cotton.

3. The apparatus of claim 2 wherein the main body has an inside portion which defines the intake end of the main body and the inside portion is dimensioned telescopingly to receive the suction tube, and the fluid channel is adapted to direct the heated fluid in a predetermined direction along a first path of travel, and the opening of the fluid channel is disposed in close proximity to the intake end of the inside portion.

4. The apparatus of claim 2 wherein the suction tube is operable to draw the cotton, and the heated fluid discharged from the fluid channel into the inside portion of the main body, the cotton and the heated fluid moving along in a predetermined direction along a second path of travel, and the first and second paths of travel are disposed in substantially parallel, fixed spaced relation one with the other.

5. The apparatus of claim 4 wherein the nozzle has a distal end and a conduit is connected in fluid transferring relation thereto and operable to channel the heated fluid to the distal end of the nozzle; and a heater is connected in fluid transferring relation to the conduit and imparts heat energy to the fluid traveling therein.

6. The apparatus of claim 5 wherein said heated fluid is heated air, a first fan is connected in fluid transferring relation with the heater and is operable to propel the heated air along the conduit and into the nozzle, and a second fan is mounted in fluid transferring communication with the suction tube and is operable to draw in the heated air discharged from the fluid channel and the cotton, and draw them along the inside portion of the main body and into the suction tube.

7. In a machine for handling unprocessed cotton and having a suction tube with an intake end for conveying said cotton along a predetermined path of travel, an apparatus for drying cotton comprising:

a nozzle having a main body mounting an inside portion, the inside portion enclosing the suction tube and defining an intake end, and an air channel having proximal and distal ends s defined by the main body, the proximal end of the air channel being disposed in close proximity to the intake end of the inside portion;

a conduit having first and second ends, the first end connected in fluid transferring relation to the distal end of the air channel;

a heater mounted in fluid transferring relation to the second end of the conduit; and a source of air to be treated supplied to the heater whereby heat energy is imparted to the air received from said source and the conduit channels the heated air to the nozzle which, in turn, delivers the heated air to the proximal end of the air channel for discharge in drying relation to the cotton entering into the inside portion of the nozzle.

8. The apparatus of claim 7 wherein the main body of the nozzle has an outside portion which is mounted to the inside portion of the nozzle, and the inside portion is operable telescopingly to receive the suction tube, and the air channel is defined between the outside portion and said inside portion.

9. The apparatus of claim 8 wherein a first fan is mounted in fluid communication with the heater and is operable to urge the heated air along the conduit and into the nozzle; and a second fan is mounted in fluid communication with the suction tube and is operable to draw in the cotton and the heated air discharged by the air channel into the inside portion of the air nozzle.

10. The apparatus of claim 9 wherein the air channel directs the heated air along a first path of travel, and the heated air and the unprocessed cotton drawn into the inside portion of the air nozzle are urged along a second path of travel, the first and second paths of travel being disposed in substantially parallel fixed spaced relation one with the other.

11. The apparatus of claim 10 wherein the second fan is operable to draw in a predetermined volume of air and the first fan is operable to deliver a volume of heated air which is substantially equal to the volume of air drawn in by the second fan.

* * * * *